US007202431B2

(12) United States Patent
Gauzin

(10) Patent No.: US 7,202,431 B2
(45) Date of Patent: Apr. 10, 2007

(54) MODULAR ELECTRICAL BREAKER AND ELECTRICAL BREAKER DEVICE COMPRISING AT LEAST ONE SUCH BREAKER

(75) Inventor: Joël Gauzin, Montpezat de Quercy (FR)

(73) Assignee: Apem, Caussade (FR)

( * ) Notice: Subject to any disclaimer, the term of this patent is extended or adjusted under 35 U.S.C. 154(b) by 0 days.

(21) Appl. No.: 10/505,480

(22) PCT Filed: Feb. 27, 2003

(86) PCT No.: PCT/FR03/00638

§ 371 (c)(1),
(2), (4) Date: Jun. 23, 2005

(87) PCT Pub. No.: WO03/073455

PCT Pub. Date: Sep. 4, 2003

(65) Prior Publication Data

US 2006/0021865 A1 Feb. 2, 2006

(30) Foreign Application Priority Data

Feb. 28, 2002 (FR) ..... 02 02561

(51) Int. Cl.
*H01H 3/00* (2006.01)

(52) U.S. Cl. ..... 200/339; 200/329

(58) Field of Classification Search ..... 200/329–339, 200/237, 5 R, 17 R, 345, 549, 550
See application file for complete search history.

(56) References Cited

U.S. PATENT DOCUMENTS

| | | | | |
|---|---|---|---|---|
| 4,760,218 | A * | 7/1988 | Gutman | 200/5 R |
| 5,198,283 | A * | 3/1993 | Hausler et al. | 428/195.1 |
| 6,013,885 | A * | 1/2000 | Kowalczyk | 200/315 |
| 6,388,221 | B1 * | 5/2002 | Rudolph et al. | 200/556 |
| 2002/0011404 | A1 * | 1/2002 | Takeda et al. | 200/339 |
| 2003/0089587 | A1 * | 5/2003 | Mayo et al. | 200/329 |

FOREIGN PATENT DOCUMENTS

| | | |
|---|---|---|
| CA | 1135393 | 9/1982 |
| DE | 41 37 890 | 5/1983 |
| DE | 42 14 794 | 11/1993 |
| DE | 92 18 404 (U) | 1/1994 |
| EP | 017 124 | 10/1980 |
| EP | 332 208 | 9/1989 |
| WO | WO 99/05691 | 2/1999 |

* cited by examiner

*Primary Examiner*—Elvin Enad
*Assistant Examiner*—M. Fishman
(74) *Attorney, Agent, or Firm*—Leydig, Voit & Mayer, Ltd.

(57) ABSTRACT

A modular electrical switch and electrical switching device includes a housing detachably mounted relative to the switching element and replaceable by another housing for a different control, and detachably fixed relative to the switching element in order to change to electrical function of the switching element or the mode of action of the switching element. The invention is particularly applicable in truck-like vehicles.

13 Claims, 6 Drawing Sheets

MODULAR ELECTRICAL BREAKER AND ELECTRICAL BREAKER DEVICE COMPRISING AT LEAST ONE SUCH BREAKER

FIELD OF THE INVENTION

This invention involves an electrical switch as well as an electrical switching device including a number of such switches.

It specifically applies, in a non-restrictive manner, to an instrument panel of a vehicle, such as a truck, a bus, a boat, an industrial or agricultural machine, or any other type of vehicle. By way of example, it can also apply to the control housings of machine tools.

BACKGROUND

In each of the foregoing applications, electrical switches are assembled on a plate of the vehicle's instrument panel or on the control housing of the machine tool, each switch includes at least one switching element of the microswitch type attached by soldering to a printed circuit board fixed to the plate behind and parallel to it, and the switching element ensures a desired and specific function, for example, a switch or reversing switch for the electronics installed on the printed circuit board. The electrical switch also includes a housing for the rocker controlling the switching element, which penetrates the instrument panel plate and is fixed to, that is to say, forms a single piece with, the switching element, the rocker being accessible externally so that an operator can control the switching element.

This known switching device has the drawback that it permanently fixes the determined electrical switching function of each switching element and control housing set, and therefore does not allow a certain flexibility in altering such a function except by having to unsolder this set from the printed circuit board to replace it with a different set, which is often tricky to do. For example, in the case of a truck instrument panel with several electrical switches controlling various truck equipment, the electrical functions accomplished by some of these switches must be changed in an evolving fashion so that the switch can accomplish not only the electrical function assigned to it, but also a supplementary electrical function. Such would be the case, for example, for an electrical switch originally intended to control the truck low beams and which could also be used thereafter to control fog lamps not originally present. In this case, it is currently necessary to replace the switch set completely, after unsoldering it, with another switch intended to accomplish this new supplementary function by resoldering it onto the printed circuit board and rewiring it to the fog lights.

SUMMARY OF THE INVENTION

The goal of this invention is eliminating this known drawback of switching devices by proposing interchangeable electrical switches, each of whose function can be modified at will without the tricky operations of unsoldering them from the printed circuit board.

For this purpose, the electrical switch of the invention, comprises at least one switching element intended to be attached by soldering to a printed circuit board to realize a determined electrical function, and a housing for a control controlling the switching element, wherein the housing is detachably fastened to the switching element and can be replaced by another different control rocker housing, detachably fixed relative to the switching element, to change the electrical function of the switching element or its mode of operation.

Advantageously, the switch includes a second switching element, fixed to the printed circuit board by soldering, to perform a determined electrical function identical to or different from the first switching element, and the control rocker housing of the first switching element, fixed detachably relative to the two switching elements, can be replaced by a different control rocker housing in order to also control the second switching element to change its electrical function or its mode of operation with regard to the previous control housing or to have it accomplish its electrical function that was inhibited with the previous control housing.

Each control rocker housing includes two elastic lateral locking feet that can be elastically engaged by clicking into two respective openings in the printed circuit board to fix the housing detachably relative to each switching element lodged in this housing.

Advantageously, each housing also includes at least one optical waveguide incorporated into it, such as an optical fiber, allowing light coming from a light source, such as a light-emitting diode soldered to the printed circuit board, to backscatter in the control rocker housing.

Each control rocker housing is made from a plastic material and includes at least one symbol visible from the outside, such as a pictogram, realized by the so-called in-mold technique (mold over film).

The invention also proposes an electrical switching device with several electrical switches specifically assembled on a plate of an instrument panel of a vehicle, such as a truck, a boat, an industrial machine, a forklift, or the like, each switch including at least one switching element attached by soldering to a printed circuit board attached behind and essentially parallel to the plate, and a housing for the rocker controlling the switching element, which penetrates the plate of the instrument panel with the rocker being accessible from the outside, and in which each housing is detachably fastened in an interchangeable manner to the printed circuit board including the switching element, and can be replaced by a different control housing permitting controlling the switching element differently.

The device advantageously includes two switching elements that can be associated with each control rocker housing, and at least one switching element or the two switching elements can be controlled according to the type of control housing chosen to realize a particular method of switching or a determined electrical function of the switching element controlled.

Each housing includes a shell permitting covering the opening of the plate through which the housing is assembled and can be adjusted and fixed in a position relative to the housing, the shell being detachably fastened to the housing by two side prongs of the housing respectively engaging elastically with the side notches of the shell.

Each control housing is fixed detachably to the printed circuit board by two elastic lateral locking feet attached to the housing, and these can be respectively engaged by clicking into two openings in the printed circuit board.

The invention will be better understood, and its other characteristic purposes, details and advantages will appear more clearly from the following explanatory description, with reference to the attached drawings, given solely by way of example to illustrate one embodiment of the invention. In these:

BRIEF DESCRIPTION OF DRAWING FIGURES

DETAILED DESCRIPTION

Figure 3:
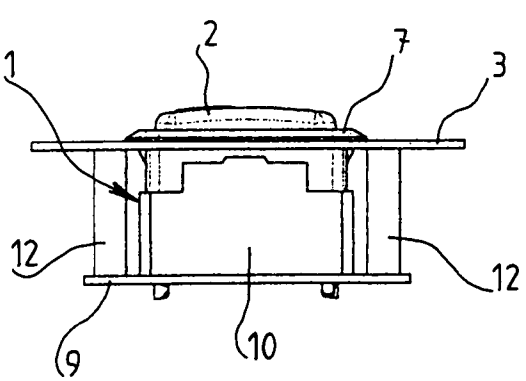
FIG. 3 is a side view according to arrow III in FIG. 2.

The electrical switching device of the invention will be described in application to the instrument panel of a vehicle, such as a truck, a bus, a boat, an industrial or agricultural machine, a forklift, or the like, but it is of course understood that it can also apply to other types of support such as electronic interface circuit boards for controlling all type of apparatus, equipment, or machines, such as, for example, a machine tool.

Referring to the figures, the electrical switching device includes several electrical switches 1, for example, three, which preferably are each manually operable control rockers 2, and are assembled on a board 3 of a vehicle's instrument panel so that the symbol 2*a* of each control rocker 2 is visible from the outside as a pictogram.

Each electrical switch 1 includes a housing 4 in which the control rocker 2 is pivotably mounted, penetrating a rectangular opening 5 through the instrument panel plate 3 and including a shell 6 to receive the control rocker 2 with an upper collar 7 resting against the external face of the plate 3 to cover the passage opening 5 for the switch housing 4.

The switch also includes at least one switching element 8, such as a microswitch, soldered onto a printed circuit card or board 9 to realize a specific electrical function, such as that of a switch or a reversing switch, in association with the different electronic components (not represented) attached to this board to accomplish specific commands and/or control functions.

Each switching element 8 comprises a small housing or base 10 soldered onto the board 9 and a switching device in the shape of small push-button 11 housed in the base 10 and movable within it under the control of the rocker 2 to realize the desired electrical contact on the printed circuit board 9.

Figure 2:
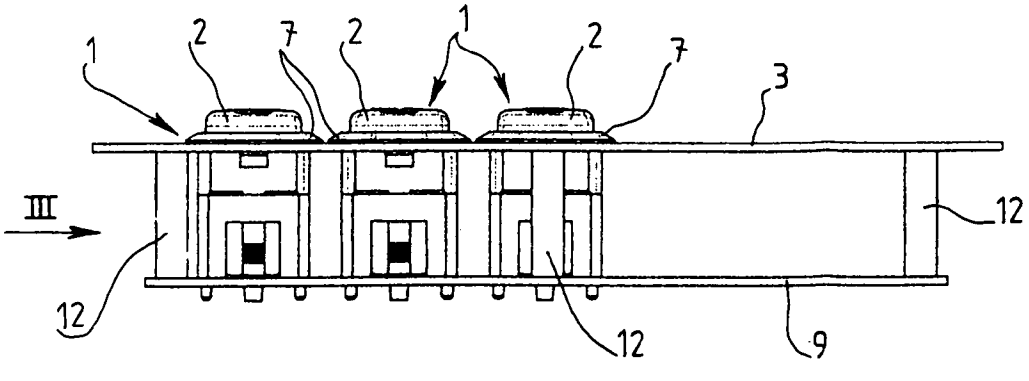
FIG. 2 is a side view according to arrow II in FIG. 1.
Figure 1:
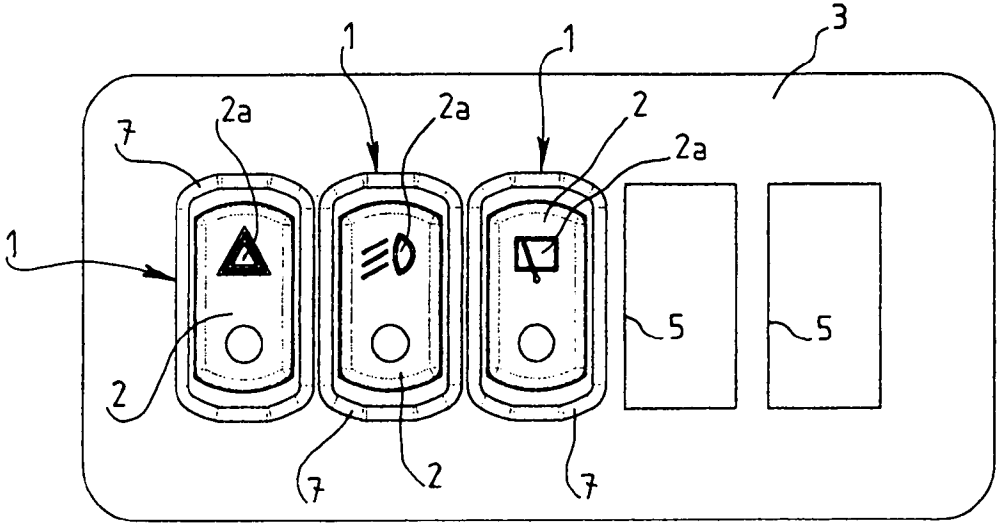
FIG. 1 is a view from above of an instrument panel plate of a vehicle including several electrical switches according to the invention.
Figure 4:
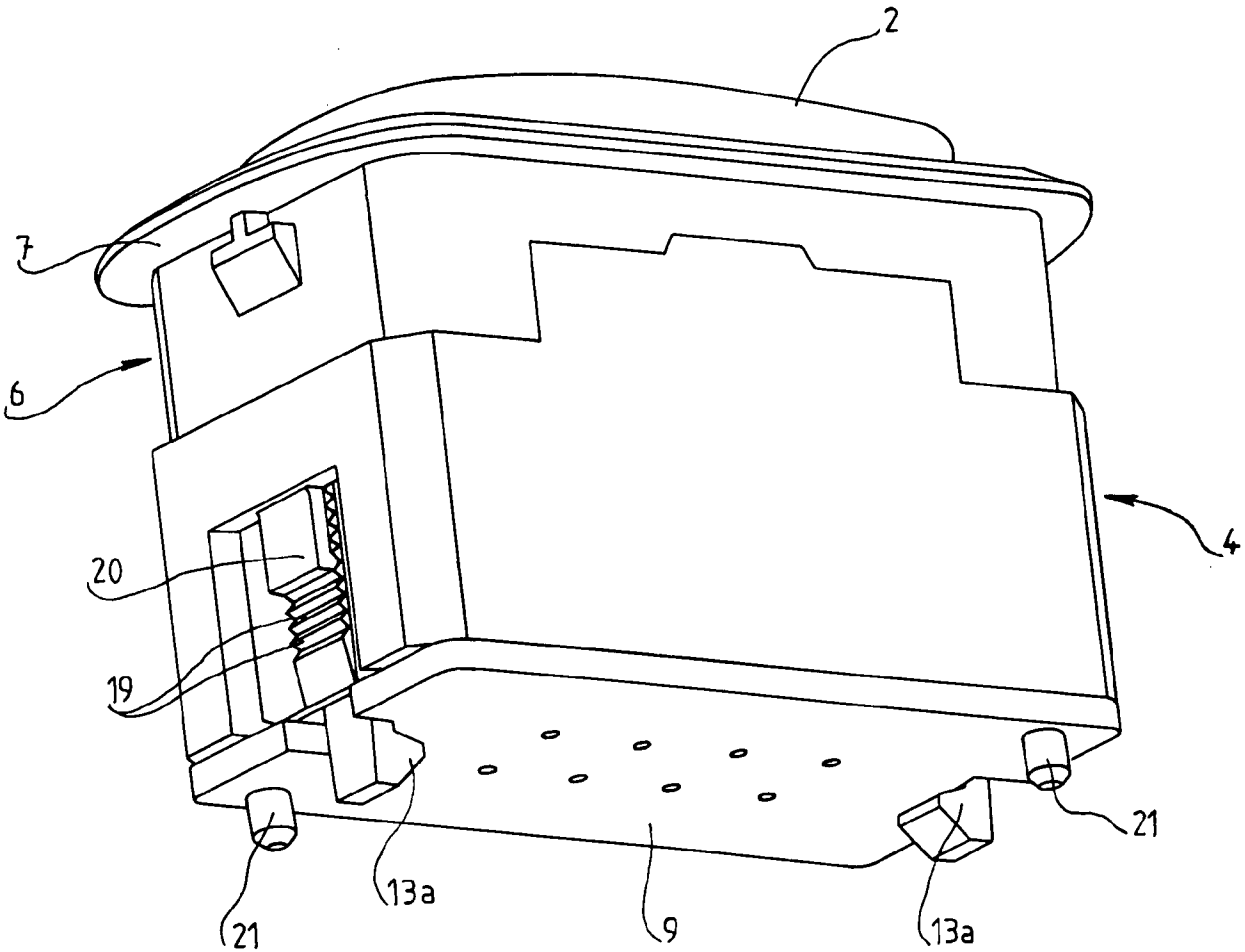
FIG. 4 is an enlarged oblique view of a switch from FIGS. 1–3 mounted in position on a printed circuit board.
Figure 5:
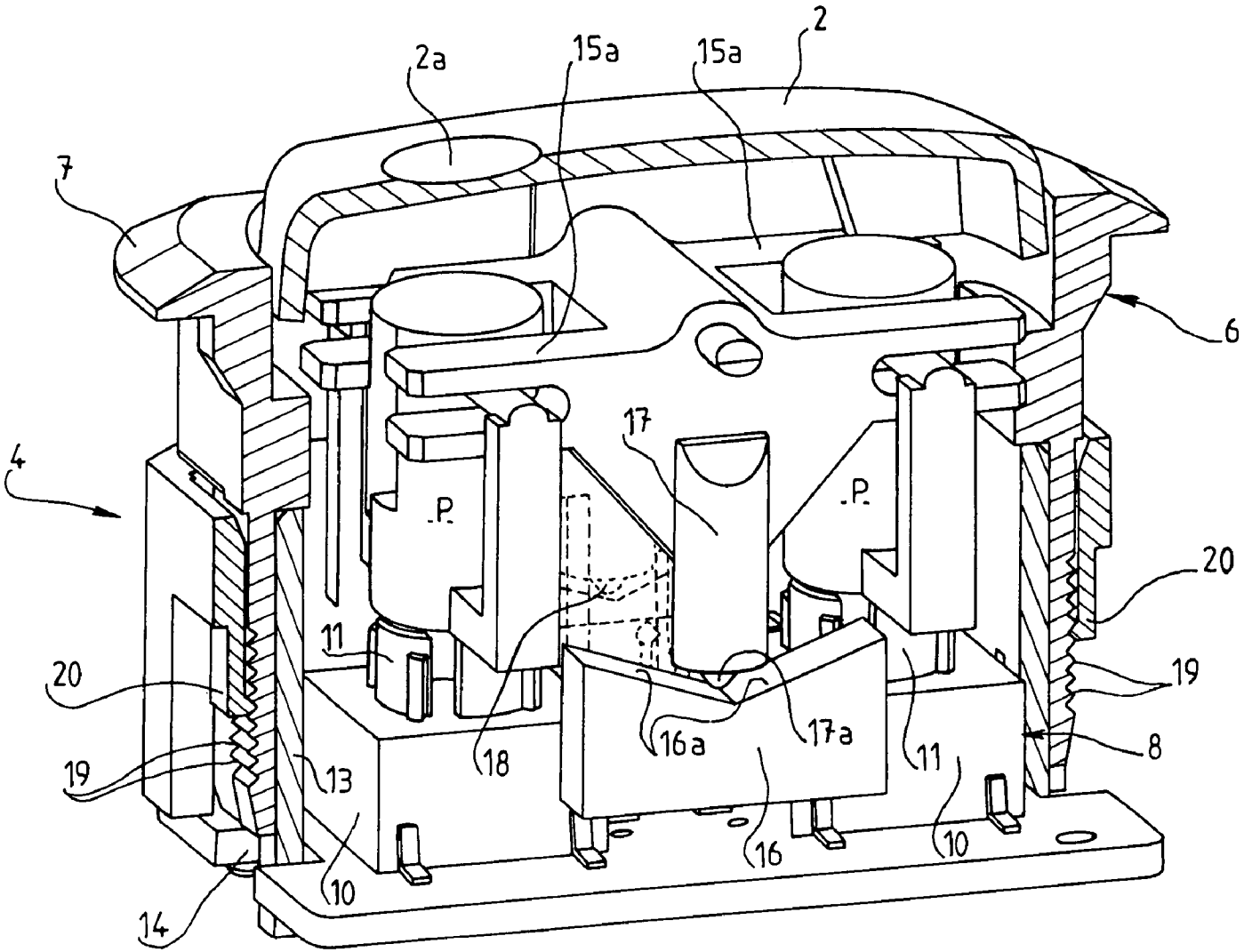
FIG. 5 is an oblique partial cutaway view of the electrical switch of FIG. 4.
Figure 6:
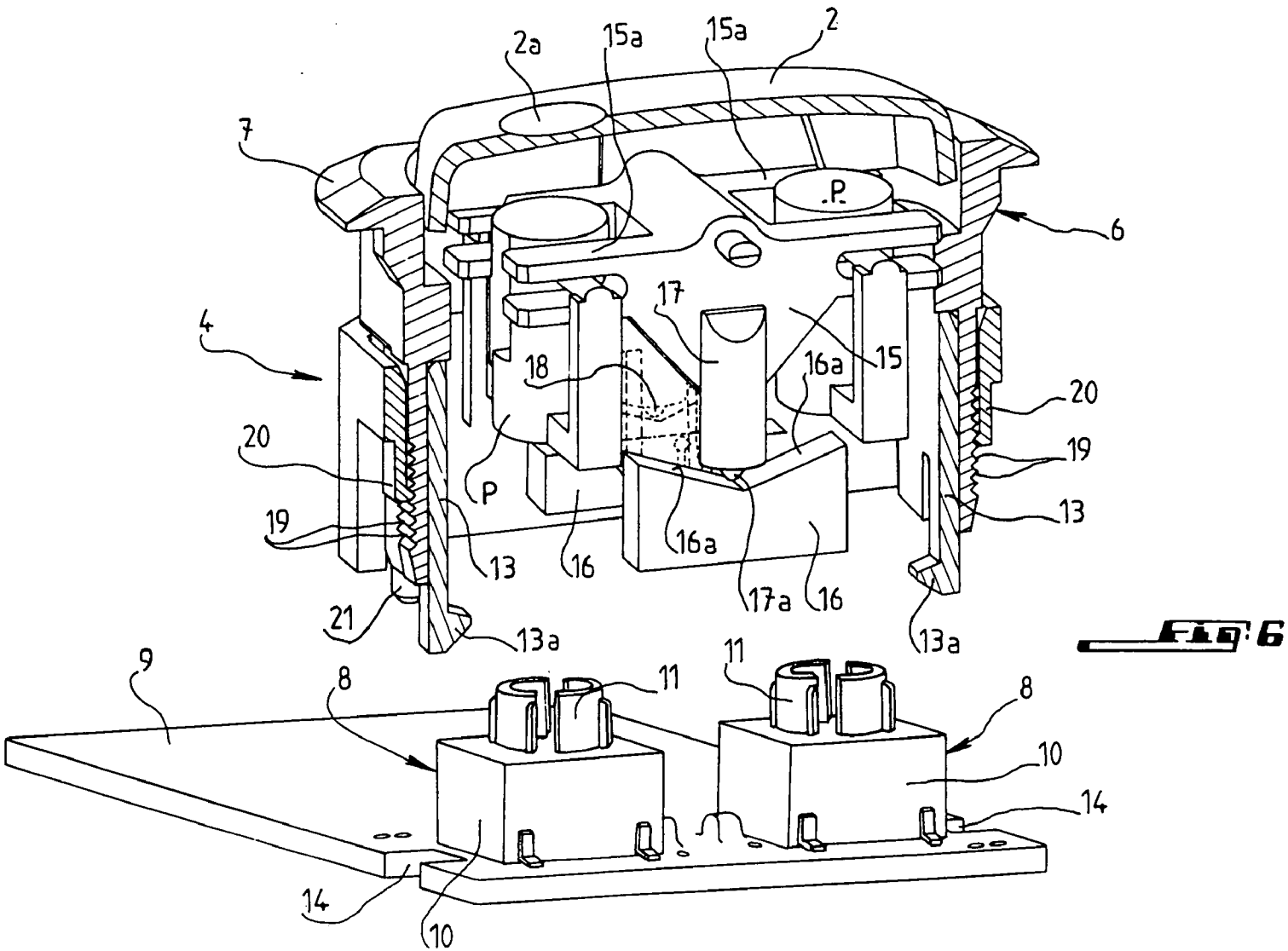
FIG. 6 is an oblique cutaway view of the electrical switch of FIG. 4 demounted from the printed circuit board.
Figure 7:
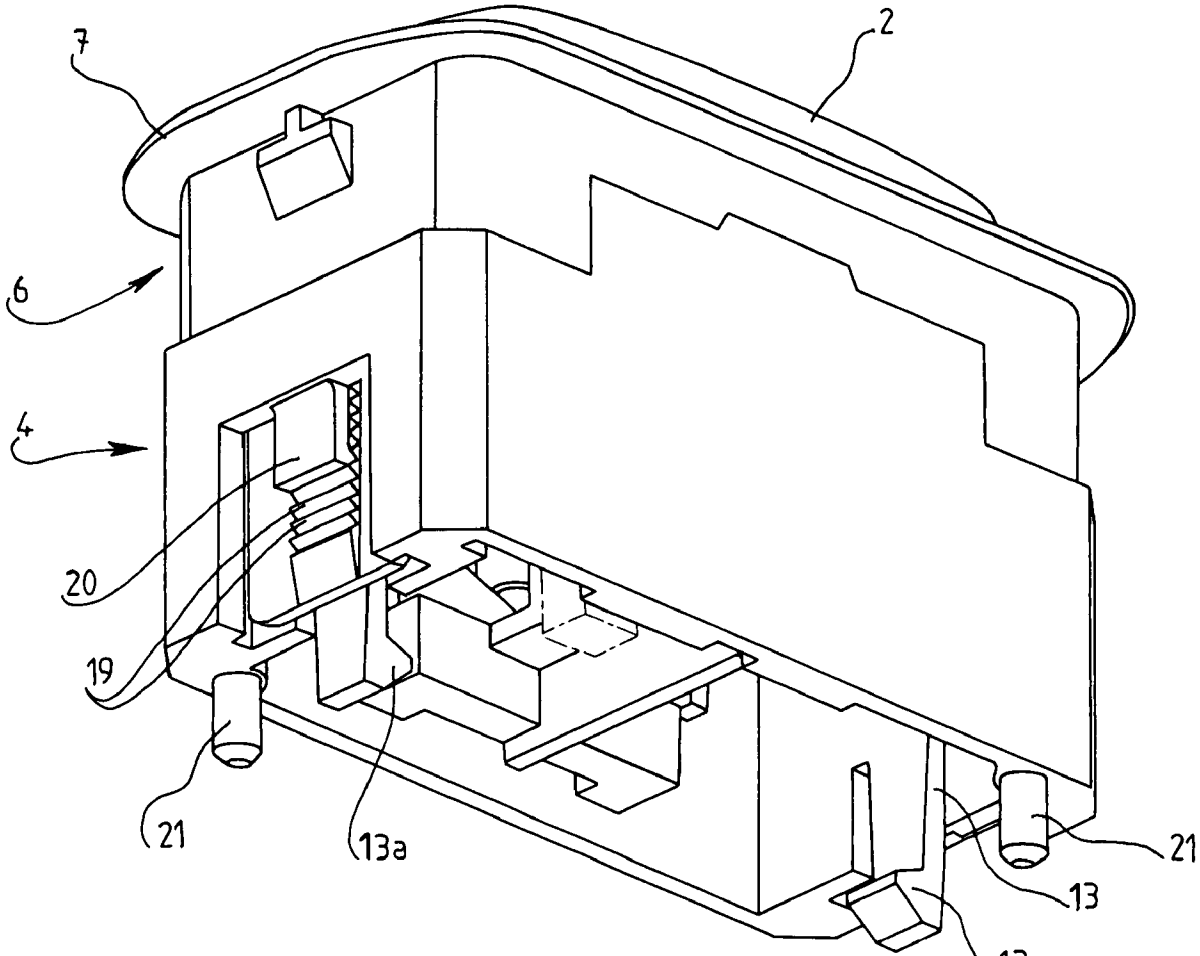
FIG. 7 is an oblique view of the underside of a part of the electrical switch of FIG. 4.
Figure 8:
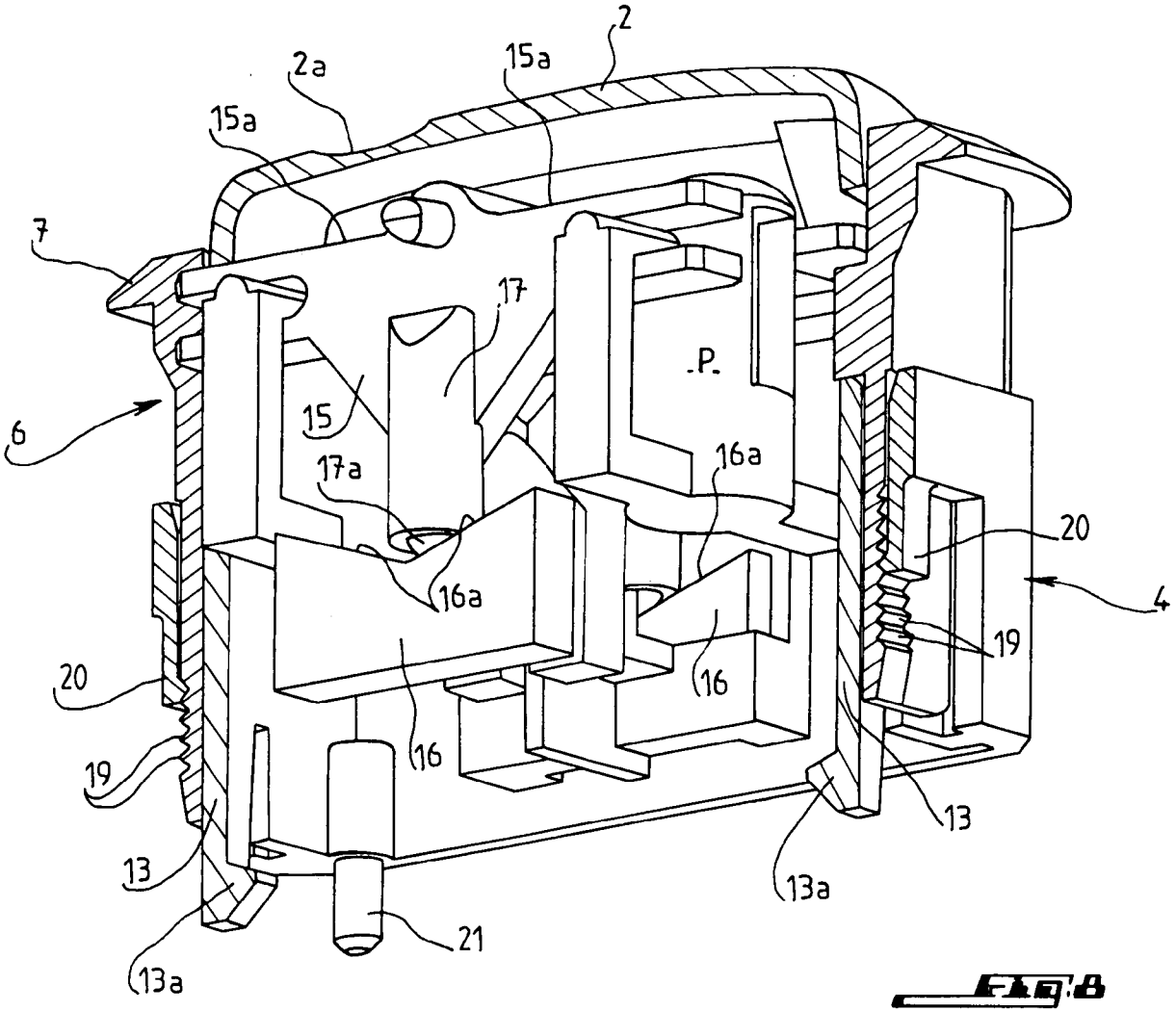
FIG. 8 is an oblique cutaway view of a part of the electrical switch of FIG. 4.

The board 9 is fixed behind and parallel to the instrument panel plate 3 by any suitable means, such as sets of screws and brackets 12 shown schematically (FIGS. 2 and 3).

According to the invention, the housing 4 of each switch 1 is detachably fixed to the printed circuit board 9 so as to accommodate within it switching element 8 and to permit the element's activation.

For this purpose, the housing 4 includes two elastic lateral locking feet 13, integrally molded with the housing 4, that can respectively engage elastically by clicking into two openings in the board 9 realized in the form of rectangular notches cut into each side of the board 9 and aligned with respect to one another. Each locking foot 13 has a hook-shaped end 13*a* that bears against the face of the board 9 opposite to the one carrying the switching element 8 to lock the housing 4 on the board 9, the housing 4 having its bottom part open to permit passage of the switching element 8 and bearing against the board 9 with its lower edge.

The housings 4 of the various electrical switches 1 are interchangeable, which already permits the user to choose among the different available electrical switches that will correspond to the electrical function sought of the switching element 8 and to its mode of operation by the corresponding rocker 2, for example a permanent activation mode in which the rocker 2 occupies a corresponding fixed position, or a push-button mode of operation where the rocker 2 returns to its original position after rocking.

Of course, each rocker 4 includes within it the different mechanical devices that permit defining the activation method of the switching element 8 associated with the function sought. These are known devices and can be constituted as represented in the figures by a lever 15 mounted to pivot on a transverse axis in the shell 6 under the action of the rocker 2 in a direction permitting activation of the corresponding switching element 8, and two identical parallel pieces 16 fixed in the housing 4 below the lever 15 and each including at least one ramp 16*a* whose shape defines the activation method of the switching element 8 associated with its electrical function by displacement on it of an arm 17, forming part of the lever 15, to permit it to follow the shape of the ramp 16*a*. Each arm 17 includes at its free lower end a device 17*a* ensuring its displacement on the ramp 16*a*, and can be constituted by a ball bearing or a friction plate retained at this end against the force of a return spring. The two arms 15*a* of lever 15 each have the shape of a fork, permitting vertical engagement with a piston P for activation of the switching device 11 of element 8, the piston P being mounted between the two associated branches of the lever arm 15*a*.

Each electrical switch thus has its own internal configuration associated with the electrical function of the switching element 8.

Preferably two switching elements 8 are soldered on the printed circuit board 9 and are accommodated in the corresponding housing 4 configured to appropriately activate one or the other of members 11 of the two switching elements 8 by toggling the rocker 2.

Thus, for example, toggling the rocker 2 in a determined direction permits operating the associated switching element 8 functioning as a switch, while the toggling the rocker 2 in the opposite direction permits activating the other switching element 8 functioning as a reversing switch. One could also envisage rocking of the rocker in one direction to provide a switching pulse action, wherein the associated switching element 8 is actuated to provide a pulse signal to an electrical circuit of the board 9.

If the user should later have to change the activation configuration of the switching elements 8, for example by suppressing the reversing switch function of one of these two elements while retaining the on-off function of the other element, it is sufficient to remove from the switch the housing 4 that includes internal activation devices of the switching elements acting respectively as switch and reversing switch, and to replace it with another switch housing 4 internally arranged so that the rocker 2 does not rock in the direction that activates the switching element 8 where is to be prevented the function, and achieves this without unsoldering this element from the printed circuit board 9.

The interchangeability of the different switches also permits adding an electrical function provided as an option. For example, the original switch associated with two switching elements 8 can permit operation of only one of these two elements, and if a new electrical function should subsequently be required using the other switching element 8, it is sufficient to replace the original switch housing 4 with a different switch housing 4 that also permits control of the second switching element 8. In the case of a truck, for example, the addition of a new electrical control function by simple changing the switch housing could consist of controlling fog lamps not originally included with this vehicle.

Changing the electrical function of the different switching elements by interchangeability of switch housings with different internal control can be facilitated by multiplexing circuits in order to avoid addition and/or suppression of electrical wires forming part of the wiring existing between the printed circuit board of the instrument panel and the various vehicle equipment to be operated and/or controlled.

The assembly comprised of the housing 4 and the shell 6 of each electrical switch is made of a plastic material, as is the rocker 2 on which symbols or pictograms 2*a* representing a specific function are realized by the so-called in-mold technique allowing all possibilities of color and/or shape of symbol and pictograms, and in particular permitting an inalterable marking of these symbol or pictograms at the same time.

Advantageously, each electrical switch can include in its housing 4 one or several optical wave guides 18, such as optical fibers, allowing backscattering in the control rocker 2 of light from a light source (not represented) such as a light-emitting diode soldered to the printed circuit board and facing the corresponding optical waveguide 18 when the housing 4 is attached to the printed circuit board 9. Switching on the light sources can be handled by control electronics on the printed circuit 9 to ensure day- and/or nighttime lighting levels of the toggle switches 2 and/or confirmation of functions associated with the switching elements 8.

The design of each electrical switch can be such that the shell 6 is a molded piece mounted independently on the housing 4 after its attachment to the printed circuit board 9. This configuration is of interest for permitting mounting of the shell before the instrument panel plate 3, and advantageously, the shell 6 carries on a series of notches 19 a part of its two side walls, extending longitudinally, with which a side prong 20 with a hooked end, produced with the housing 4 during molding, can be engaged elastically, and permitting locking the shell 6 to a relative position in the housing 4 to make up for the possible level differences that can exist between the printed circuit board 9 and the instrument panel plate 3. Such an assembly of the shell 6 to the housing 4 allows the housing to be mounted from the rear of the plate 3 when it has been previously locked to the printed circuit board 9, or from the front of the plate 3 when the housing 4 must be locked onto the card 9 after the card has been fixed behind the plate 3.

Each housing 4 includes two pins 21 for positioning the housing 4 on the board 9 and, therefore, with respect to the associated switching elements 8. The two pins 21 project from the lower edge of the bottom part of rectangular profile of the housing 4, are diagonally opposite each other, and respectively enter into two complementary holes in the board 9.

The various electrical switch modules can be installed with indifference on the printed circuit board 9, permitting modification of the electrical function(s) accomplished by the switching elements 8 at will without any tricky operations of unsoldering these elements. This design not only permits flexibility in modification of electrical functions achieved by the electrical switches, but also a perfect adaptability to multiplexing.

The invention claimed is:

1. A modular electrical switching assembly comprising:

a first electrical switching element, mountable on a printed circuit board, and providing a plurality of selectable electrical connections selected in response to mechanical actuation of the first electrical switching element;

a first housing detachably attachable to the printed circuit board and including a first control rocker movable by pivoting between first and second positions, the first control rocker engaging for actuation the first switching element when the first housing is attached to the printed circuit board covering the first electrical switching element, to provide a first operational mode of the first electrical switching element; and a second housing detachably attachable to the printed circuit board and including a second control rocker movable by pivoting between first and second positions, the second control rocker engaging for actuation the first switching element when the second housing is attached to the printed circuit board covering the first electrical switching element, to provide a second operational mode of the first electrical switching element, different from the first operational mode.

2. The modular electrical switching assembly according to claim 1 comprising a second electrical switching element, mountable on the printed circuit board, and providing a plurality of selectable electrical connections selected in response to mechanical actuation of the second electrical switching element, wherein the first control rocker engages for actuation both the first and second switching elements when the first housing is attached to the printed circuit board covering the first and second switching elements, and the second control rocker engages for actuation only the first switching element when the second housing is attached to the printed circuit board covering the first and second electrical switching elements.

3. The modular electrical switching assembly according to claim 1, wherein each of the first and second housings includes extending pins for engaging corresponding respective openings in the printed circuit board when the respective housing is attached to the printed circuit board.

4. The modular electrical switching assembly according to claim 1, wherein each of the first and second housings includes at least one optical waveguide so that light from a light source traveling and through the optical waveguide is scattered in the respective housing.

5. The modular electrical switching assembly according to claim 1, wherein each of the first and second control rockers is made of a plastic and includes at least one symbol visible from outside the respective first and second housings.

6. A modular electrical switch assembly comprising:

a printed circuit board;

a plate spaced from the printed circuit board and including a plurality of openings;

a plurality of electrical switches, each switch being disposed in a respective opening of the plate and between the plate and the printed circuit board, each switch comprising a respective first electrical switching element, mounted on the printed circuit board, and providing a plurality of electrical connections selected in response to mechanical actuation of the first electrical switching element, and a first housing detachably attached to the printed circuit board, covering the first electrical switching element, and including a first control rocker movable by pivoting between first and second positions, the first control rocker engaging for actuation the first switching element to provide a first operational mode of the first electrical switching element; and a second housing detachably attachable to the printed circuit board in replacement of one of the first housings, the second housing including a second control rocker movable by pivoting between first and second positions, the second control rocker engaging for actuation the corresponding first switching element when the second housing is attached to the printed circuit board and covers the corresponding first switching element, to provide a second operational mode of the first electrical switching element, different from the first operational mode.

7. The modular electrical switch assembly according to claim 6, wherein at least one of the electrical switches includes a second electrical switching element mounted on the printed circuit board, providing a plurality of selectable electrical connections selected in response to mechanical actuation of the second electrical switching element and the corresponding first housing of the switch including the second electrical switching element covers the first and second electrical switching elements and the first control rocker engages for actuation the second switching element, and the second control rocker, when the second housing is mounted on the printed circuit board in place of the first housing, covering the first and second electrical switching elements, engages for actuation only the first electrical switching element.

8. The modular electrical switch assembly according to claim 6, wherein at least one of the electrical switches includes a second electrical switching element mounted on the printed circuit board, providing a plurality of selectable electrical connections selected in response to mechanical actuation of the second electrical switching element and the corresponding first housing of the switch including the second electrical switching element covers the first and second electrical switching elements and the first control rocker engages for actuation only the first switching element, and the second control rocker, when the second housing is mounted on the printed circuit board in place of the first housing, covering the first and second electrical switching elements, engages for actuation both of the first and second electrical switching elements.

9. The modular electrical switch assembly according to claim 6, wherein each of the first and second housings includes extending pins for engaging corresponding respective openings in the printed circuit board when the respective housing is attached to the printed circuit board.

10. The modular electrical switch assembly according to claim 6, wherein each of the first and second housings includes at least one optical waveguide so that light from a light source and traveling through the optical waveguide is scattered in the respective housing.

11. The modular electrical switch assembly according to claim 6, wherein each of the first and second control rockers is made of a plastic and includes at least one symbol visible from outside the respective first and second housings.

12. The modular electrical switch assembly according to claim 6, wherein each of the switches disposed between the printed circuit board and the plate includes a shell inserted into the corresponding opening in the plate, adjustably and securably engaging the respective housing of the corresponding switch and including a peripheral collar contacting the plate adjacent the respective opening.

13. The modular switch assembly according to claim 12, wherein each of the first and second housings includes a pair of elastic locking feet with hooks for engaging the printed circuit board, and a pair of elastic prongs at opposite sides of each of the first and second housings, and each of the shells includes a plurality of notches, generally parallel to the panel, at each of two opposite sides of each of the shells and the prongs of the respective housings engage respective notches for adjusting positions of respective shells relative to the panel.

* * * * *